US006045462A

United States Patent [19]

Mourek

[11] Patent Number: 6,045,462

[45] Date of Patent: Apr. 4, 2000

[54] TENNIS BALL TEE

[76] Inventor: Michael Mourek, 2 S. 601 Danbury Dr., Glen Ellyn, Ill. 60137

[21] Appl. No.: 09/002,611

[22] Filed: Jan. 5, 1998

Related U.S. Application Data

[63] Continuation-in-part of application No. 08/871,223, Jun. 9, 1997.

[51] Int. Cl.[7] ..... A63B 69/40

[52] U.S. Cl. ..... 473/417

[58] Field of Search ..... 473/417, 387, 473/395, 399, 423, 401, 189, 191

[56] References Cited

U.S. PATENT DOCUMENTS

| | | | |
|---|---|---|---|
| 2,272,765 | 2/1942 | Beeson et al. | 473/417 |
| 2,527,906 | 10/1950 | Bennett et al. | 473/417 |
| 2,884,250 | 4/1959 | Patterson | 473/417 |
| 3,139,282 | 6/1964 | Lande | 473/417 |
| 3,183,000 | 5/1965 | Dix | 473/417 |
| 4,176,838 | 12/1979 | Griffin | 473/417 |
| 4,227,691 | 10/1980 | Lefebvre et al. | 473/417 |
| 4,364,563 | 12/1982 | Stafford | 473/417 |
| 5,100,134 | 3/1992 | Becker | 473/417 |
| 5,772,536 | 6/1998 | Wang | 473/417 |

*Primary Examiner*—Raleigh W. Chiu
*Attorney, Agent, or Firm*—Robert L. Marsh

[57] ABSTRACT

A practice tee for holding a tennis ball, has a base, a flexible stem extending upward from the base, and an upwardly opening cup at the upper end of the cup. The stem has sufficient flexibility to bend in response to the impact of a tennis racket hitting a tennis ball held by the cup so as to not damage the racket.

4 Claims, 3 Drawing Sheets

TENNIS BALL TEE

The present application is a continuation-in-part of the applicant's previous application filed Jun. 9, 1997 and assigned Ser. No. 08/871,223.

The present application relates to practice devices for improving sporting skills, and in particular to a practice tee for retaining a tennis ball.

BACKGROUND OF THE INVENTION

The present invention relates to the game of tennis. For the maximum control of the tennis ball, the grip and swing of the tennis racket, and the position of the ball relative to the racket at the point of impact are all important. Generally, a tennis player will develop his or her swing by striking balls fed by an opponent at the opposite side of a tennis net. Frequently, a tennis player will seek to improve certain aspect of his or her swing, for example, the ability to strike a ball positioned only a few inches above the play surface. A tennis player's most effective shots, however, are made when the player impacts the ball at approximately a waist-high elevation.

Presently, a tennis player who seeks to improve certain aspects of his tennis swing must enlist the cooperation of another person to feed balls in the desired motion for the player to return. It would be desirable, therefore, to provide a device whereby a tennis ball could be retained at a predetermined elevation such that a player can practice his swing with respect to a ball at that elevation.

SUMMARY OF THE INVENTION

Briefly, the present invention is embodied in a practice tee for holding a tennis ball such that it may be stricken by a tennis player's racket. The invention includes a base which, in the preferred embodiment, is weighted and is adapted to rest on the horizontal surface of the earth. Extending vertically from the base is an elongate stem, and at the upper end of the elongate stem is an upwardly opening cup for retaining a tennis ball thereon. The elongate stem is made of a resilient material such that the upper end of the tee is returnable to a vertical position after the stem is bent through an arc of at least 90 degrees. The stem must also have sufficient strength to return to the vertical position while bearing the weight of a tennis ball in the cup at the upper end thereof. In the preferred embodiment, the stem consists of a cylindrical linear shaft of spring steel having a diameter of between 1/16 and 1/8 inch, such that it will bend when it is struck by a tennis racket. Also, the upper end of the stem is surrounded by a flexible plastic which will cause less damage to the racket when it is swung at a ball on the cup at the top of the stem.

In the preferred embodiment, a stem adapted to support a tennis ball three feet above the ground may be bent through an arc of at least 90 degrees by the application of a one pound force at the distal end of the stem which is perpendicular to the length thereof. In order that the practice tee be easily transportable, it is also desirable that the stem be easily detachable from the base.

BRIEF DESCRIPTION OF THE DRAWINGS

A better understanding of the present invention will be had after a reading of the following detailed description taken in conjunction with the accompanying drawings wherein.

DETAILED DESCRIPTIONOF THE PREFERRED EMBODIMENT

Figure 2:
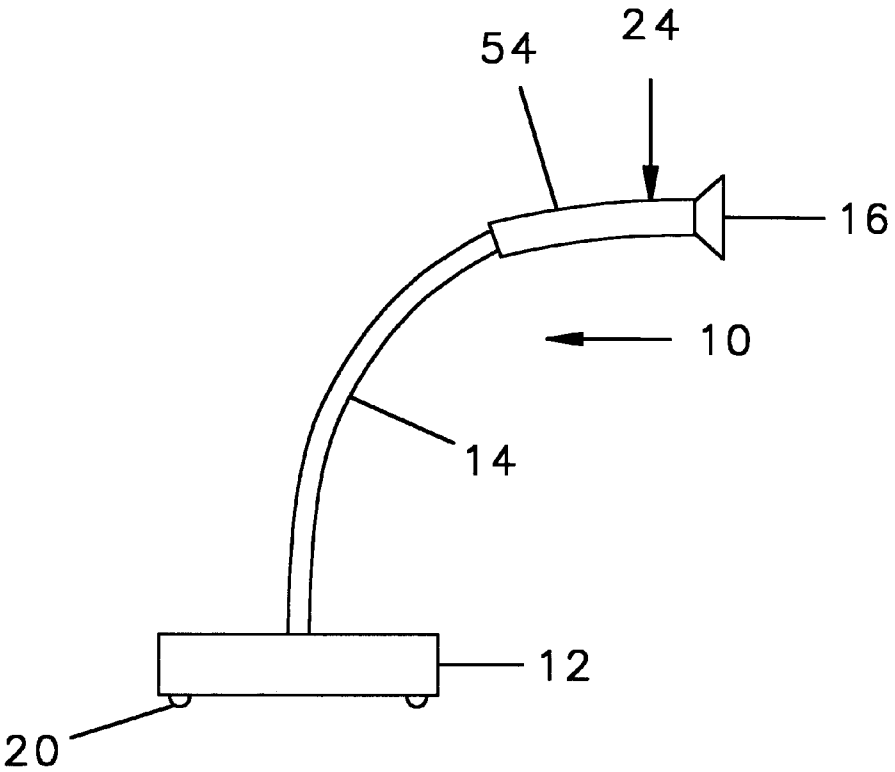
FIG. 2 is a side elevational view of the tennis tee shown in FIG. 1 in which the stem thereof is bent through an arc of approximately 90 degrees.
Figure 1:
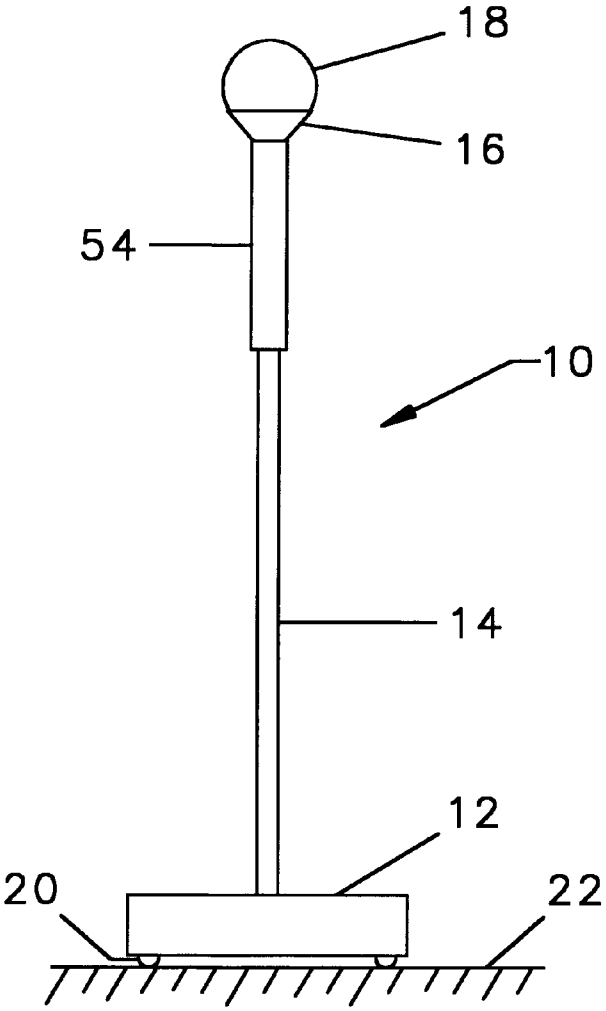
FIG. 1 is a side elevational view of a tennis ball tee in accordance with the present invention.

Referring to FIGS. 1 and 2, a tennis ball tee 10 in accordance with the present invention includes a generally planar base 12 suitable for retaining a vertically extending stem 14 in an erect orientation while a ball fitted on the top of the stem is stricken by a tennis racket, not shown. At the upper end of the stem 14 is an upwardly opening cup 16 suitably sized to retain a tennis ball 18 thereon.

The base 12 may provide for broad coverage of the ground upon which the tee 10 is positioned or, alternately, may be made of material having substantial weight such that the vertical orientation will not be lost when the upper end of the stem 14 is stricken by a tennis racket. In the preferred embodiment, for a three foot high tee, the base 12 is made of a ½ inch thick generally square in shape nine pound steel plate having a plurality of feet 20 extending from the lower surface thereof for engaging the play surface 22 of a tennis court. Preferably, the stem 14 is made of a high quality spring steel having a diameter between 1/8 inch and 1/16 inch and is configured as a linear shaft, that is, not as a coil spring. A stem 14 made of such spring steel will have flex, i.e., it will have an urge to return to its original orientation while supporting the weight of a tennis ball 18 in the cup 16 at the upper end thereof.

A stem 14 made of spring steel as described above will have sufficient flexibility to withstand an impact from a tennis racket, and will not have such rigidity as to cause substantial damage to the outer rim of a tennis racket which strikes the ball 18 in the cup 16. By way of example, the stem 14 should have sufficient flex to bend through an arc of 90 degrees, as depicted in FIG. 2 when a force 24 is applied perpendicular to the upper end of the length of a stem 14. For a tee 10 having a stem 14 of approximately 3 feet in height, the force 24 should be approximately one pound.

Figure 3:
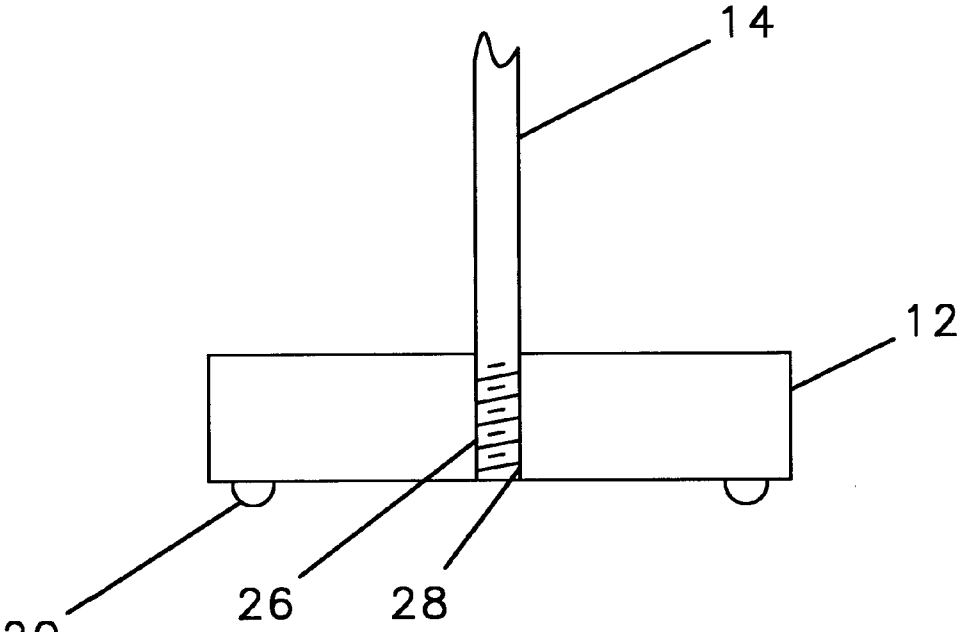
FIG. 3 is an enlarged cross-sectional view of the base of the tennis ball tee shown in FIG. 1 with the stem attached thereto.

Referring to FIG. 3, the stem 14 may be retained in a vertical orientation with respect to the base 12 by any appropriate means such as extending the lower end of the stem into a centrally located vertical bore 26 in the base, and welding or brazing the parts into assembled relationship. The welding qualities of the steel of the base 12, however, may be greatly different from the welding qualities of the stem 14 and it is, therefore, preferable to bond the parts together using a strong adhesive, or to provide threadings at the lower end of the stem 14 and complementary threadings in the vertically oriented centrally located bore in the base 12.

Figure 5:
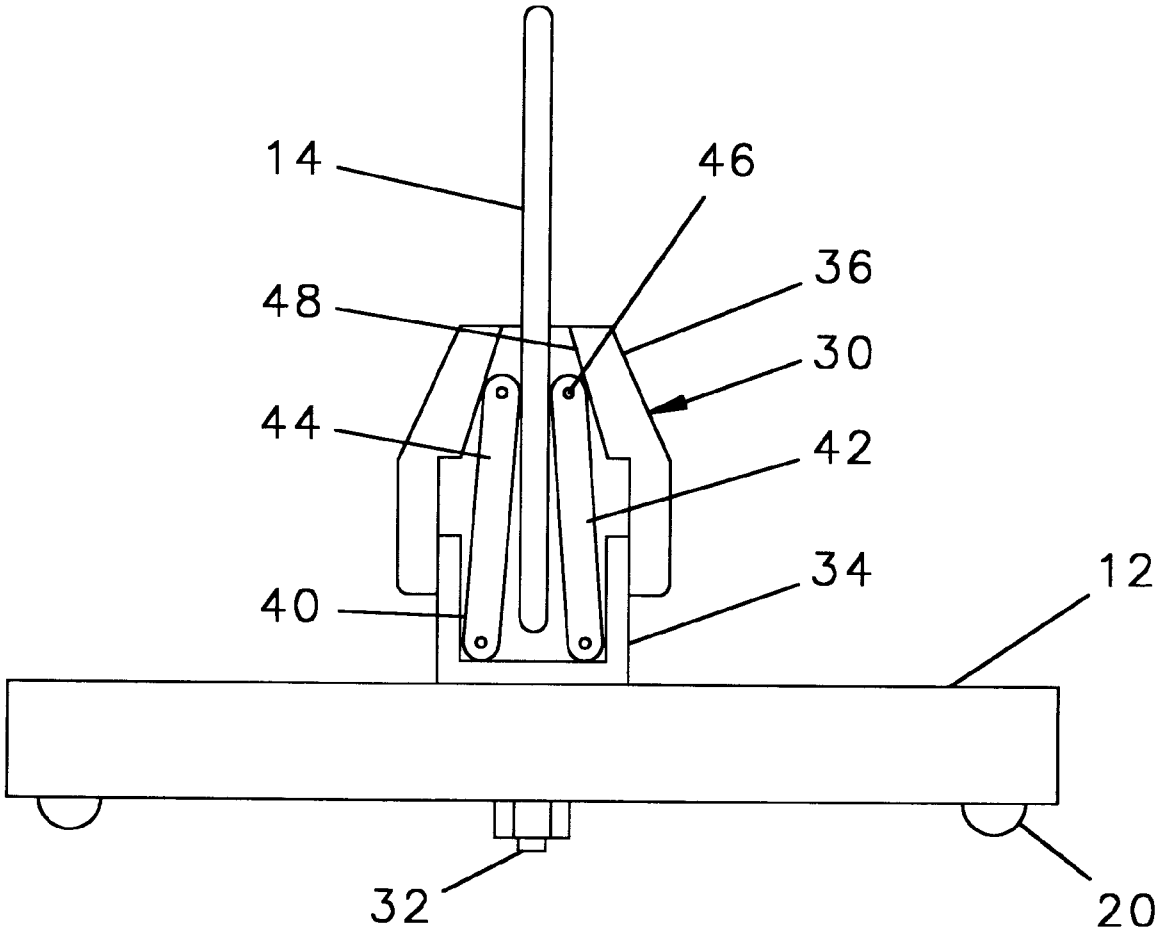
FIG. 5 is an enlarged cross-sectional view of an alternate embodiment for retaining the stem to the base of a tee in accordance with the invention.

Referring to FIG. 5, in an alternate embodiment for retaining the stem 14 to the base 12, a releasable grip lock 30, or keyless chuck, is attached to the base 12 by any suitable means such as a bolt 32. The grip lock 30 may have any structure which will releaseably retain the stem 14, and in one embodiment the grip lock 30 has a fixed tubular lower portion 34 having exterior threads at the upper end thereof. A tubular upper portion 36 has inner threads which engage the exterior threads of the lower portion 34.

Within the lower portion 34 are a plurality of elongate jaw members, two of which 40 and 42 are shown. The lower ends of the jaw members 40, 42 are pivotally mounted to the lower portion 34 to allow the upper gripping ends 44, 46 thereof to move radially inwardly or radially outwardly. The jaw members 40, 42 are biased, either by means of a spring (not shown) or by gravity to move the gripping ends radially outwardly.

The inner surface 48 of the upper member 36 is frustoconical such that threading the upper member 36 downwardly with respect to the lower member will force the gripping end 44, 46 of the jaw members 40, 42 to converge and lock around the stem 14. Threading the upper member upwardly will release the stem 14 from the gripping ends 44, 46 of the jaw members so that the stem 14 can be removed to thereby facilitate the moving and storage of the tee 10.

I have learned that it is more desirable to use a releasable grip lock 30 to retain the stem 14 to the base 12 than to provide threads on the parts or bonding the parts with a weld or braze because the lower end of a spring steel stem may fail by breaking where the parts are threaded together or bonded. It may be that cutting the threadings or the bonding process significantly reduces the strength of the spring steel near the base causing the failure whereas the releasable grip causes no damage to the lower end of the stem.

Figure 4:
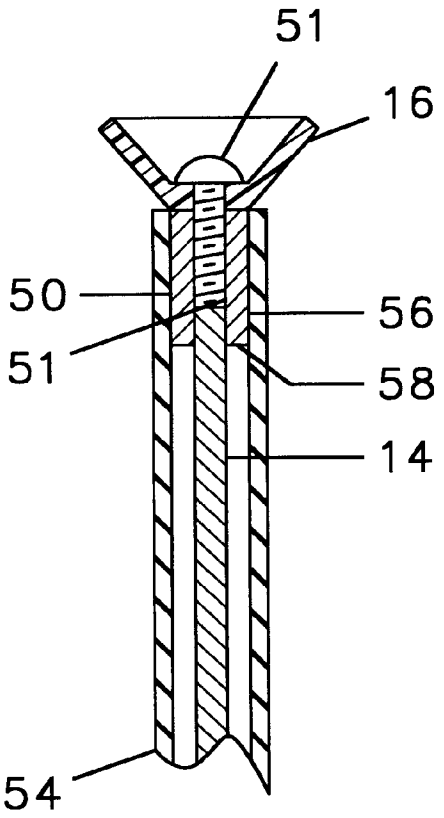
FIG. 4 is an enlarged cross-sectional view of the upper end of the stem and cup of the tennis tee shown in FIG. 1.

Referring to FIG. 4, the upwardly opening cup 16 may also be secured to the upper end of the stem 14 by any appropriate means. In the preferred embodiment a tubular aluminum retainer 50 having an inner bore 51 the lower portion of which is sized to fit around the stem 14 is positioned on the upper end thereof. The retainer 50 may be bonded to the stem using a suitable adhesive. The upper portion of the bore 51 is threaded to receive a screw 52 which extends axially through the flexible plastic cup 16 and into the upper end of the retainer 50.

Surrounding the upper end of the stem 14 is a flexible plastic sleeve 54 the inner diameter of which is equal to the outer diameter of the tubular retainer 50, and the upper end of the sleeve 54 is retained to the outer surface of the retainer 50 by an adhesive 56. The flexible sleeve 54 reduces the damage caused to a tennis racket which strikes a ball on the tee 10. The sleeve 54 also prevents the retainer 50 from being forced off the stem 14 by a tennis racket or other object striking the lower end 58 thereof.

It should be appreciated that stem 14 of the tee of the present invention may be provided in any of a number of lengths thereby permitting one to practice striking the ball at any of a number of elevations. The same base 12 may also be used to receive a plurality of stems 14.

While two embodiments of the present invention have been shown and described, it will be apparent to those skilled in the art that many changes and modifications may be made without departing from the true spirit and scope of the present invention. It is the intent of the appended claims to cover all such changes and modifications which fall within the true spirit and scope of the invention.

What is claimed:

1. A practice tee for holding a tennis ball comprising, a base adapted to rest on a horizontal surface, a unitary elongate linear stem extending vertically from said base, said stem having an upper end, said elongate stem made of spring steel, a tubular retainer around said upper end of said stem, a cup at said upper end of said tubular retainer, and a screw extending through said cup and into an upper end of said tubular retainer.

2. A practice tee in accordance with claim 1 and further comprising a plastic sleeve fitted around said stem.

3. A practice tee in accordance with claim 2 wherein an upper end of said sleeve is bonded to said retainer.

4. A practice tee for holding a tennis ball comprising a base adapted to rest on a horizontal surface, a unitary elongate linear stem extending vertically from said base, said stem having an upper end, a cup at said upper end of said stem, a tubular retainer fitted around said upper end of said stem, a sleeve having an upper end, and said sleeve around said stem with said upper end fitted around said retainer.

* * * * *